US005083663A

United States Patent [19]

Conway et al.

[11] Patent Number: 5,083,663

[45] Date of Patent: Jan. 28, 1992

[54] PLASTIC DISPLAY BOX INCLUDING AN EASEL PANEL AND FOLDABLE BLANK

[76] Inventors: Gerald A. Conway, 3133 Fairfax Rd., Cleveland, Ohio 44118; Danny J. Kump, 200 Chatham Way, Mayfield, Ohio 44124

[21] Appl. No.: 571,090

[22] Filed: Aug. 22, 1990

Related U.S. Application Data

[63] Continuation of Ser. No. 177,485, Apr. 1, 1988, abandoned.

[51] Int. Cl.[5] ..... B65D 5/52; B65D 6/26

[52] U.S. Cl. ..... 206/45.26; 211/45; 211/50; 211/88; 211/113; 220/6; 220/7; 248/463

[58] Field of Search ..... 206/45.24, 45.25, 45.26, 206/44 R, 485, 425; 211/11, 113, 45, 50, 88, 94; 248/126, 459, 463; 229/DIG. 4; 220/6, 7

[56] References Cited

U.S. PATENT DOCUMENTS

| | | | |
|---|---|---|---|
| 1,462,051 | 7/1923 | Seifert | 206/45.26 |
| 1,909,472 | 5/1933 | Keppler | 206/45.26 |
| 2,125,725 | 8/1930 | Jaques | 206/45.25 |
| 2,325,273 | 7/1943 | Pung | 206/45.26 |
| 2,730,232 | 1/1956 | Coe | 206/45.26 |
| 2,975,905 | 3/1961 | Foland | 248/259 |
| 3,222,437 | 12/1965 | Schilling | 229/DIG. 4 |
| 3,497,127 | 2/1970 | Box | 220/6 X |
| 3,511,386 | 5/1970 | Greenberger | 211/88 |
| 3,649,398 | 3/1972 | Keith | 229/DIG. 4 |
| 3,744,623 | 7/1973 | Woofter | 220/6 X |
| 4,579,232 | 4/1986 | Fedale | 211/50 |
| 4,630,731 | 12/1986 | Albery | 206/425 |
| 4,650,111 | 3/1987 | Jahoda | 206/45.25 X |
| 4,819,792 | 4/1989 | Christian | 206/45.25 |
| 4,828,121 | 5/1989 | Willcocks, Jr. | 211/94 |

FOREIGN PATENT DOCUMENTS

| | | | |
|---|---|---|---|
| 133862 | 1/1947 | Australia | 206/45.26 |

*Primary Examiner*—Bryon P. Gehman

*Attorney, Agent, or Firm*—Fay, Sharpe, Beall, Fagan, Minnich & McKee

[57] ABSTRACT

A foldable display box is made from a blank so that it may be shipped flat and assembled at its point of use. The blank includes a back panel, a bottom panel and a front panel hinged together along two fold lines. A pair of side panels extends from opposite edges of the front panel. The side panels each carry a flange which extends normal to the major plane of the sides and a pair of hook-shaped detent projections face the flange. Openings are formed in the back panel which receive the detent projection. The back panel is thus captured between the flange and the detent projection, holding the display box firmly assembled. An easel panel is formed to fold out of the back and bottom panels to support the display stand on a flat surface. The easel panel is divided into two portions by a hinge or fold line, with one portion forming an upstanding leg and the other portion being connectable to the bottom of the back panel. When in the folded out position the easel panel together with the back panel forms a triangular support to stabilize the assembled display box on a flat surface. The fold line in the easel panel is positioned coincident with the fold line which connects the back panel and bottom panel so that if the easel panel is not used, the box may still be readily assembled. The display box is formed of a rigid injection molded and preferably clear plastic material.

13 Claims, 3 Drawing Sheets

PLASTIC DISPLAY BOX INCLUDING AN EASEL PANEL AND FOLDABLE BLANK

This application is a continuation of U.S. Ser. No. 177,485 which was filed on Apr. 1, 1988 and is now abandoned.

BACKGROUND OF THE INVENTION

The present invention relates to display boxes which may be shipped flat and assembled easily by the retailer or other user wishing to display articles such as literature or brochures. One such display box is shown in U.S. Pat. Nos. Des. 286,113 and 4,630,731. Such box is formed of vacuum formed thin quite flexible plastic sheet and, when assembled, presents a somewhat cheap appearance which may detract from the product displayed. Moreover, the box cannot readily be supported on a flat surface or be hung from a vertical surface.

SUMMARY OF THE INVENTION

The present invention provides a foldable display box made from a blank so that it may be shipped flat and assembled at its point of use. The blank includes a back panel, a bottom panel and a front panel hinged together along two fold lines. A pair of side panels extends from opposite edges of the front panel. The side panels each carry a flange which extends normal to the major plane of the sides and a pair of hook-shaped detent projections face the flange. Openings are formed in the back panel which receive the detent projection. The back panel is thus captured between the flange and the detent projection, holding the display box firmly assembled. An easel panel is formed to fold out of the back and bottom panels to support the display stand on a flat surface. The easel panel is divided into two portions by a hinge or fold line, with one portion forming an upstanding leg and the other portion being connectable to the bottom of the back panel. When in the folded out position the easel panel together with the back panel forms a triangular support to stabilize the assembled display box on a flat surface. The fold line in the easel panel is positioned coincident with the fold line which connects the back panel and bottom panel so that if the easel panel is not used, the box may still be readily assembled. The display box is formed of a rigid injection molded and preferably clear plastic material.

To the accomplishment of the foregoing and related ends the invention, then, comprises the features hereinafter fully described and particularly pointed out in the claims, the following description and the annexed drawing setting forth in detail certain illustrative embodiments of the invention, these being indicative, however, of but a few of the various ways in which the principles of the invention may be employed.

DESCRIPTION OF PREFERRED EMBODIMENTS

Figure 1:
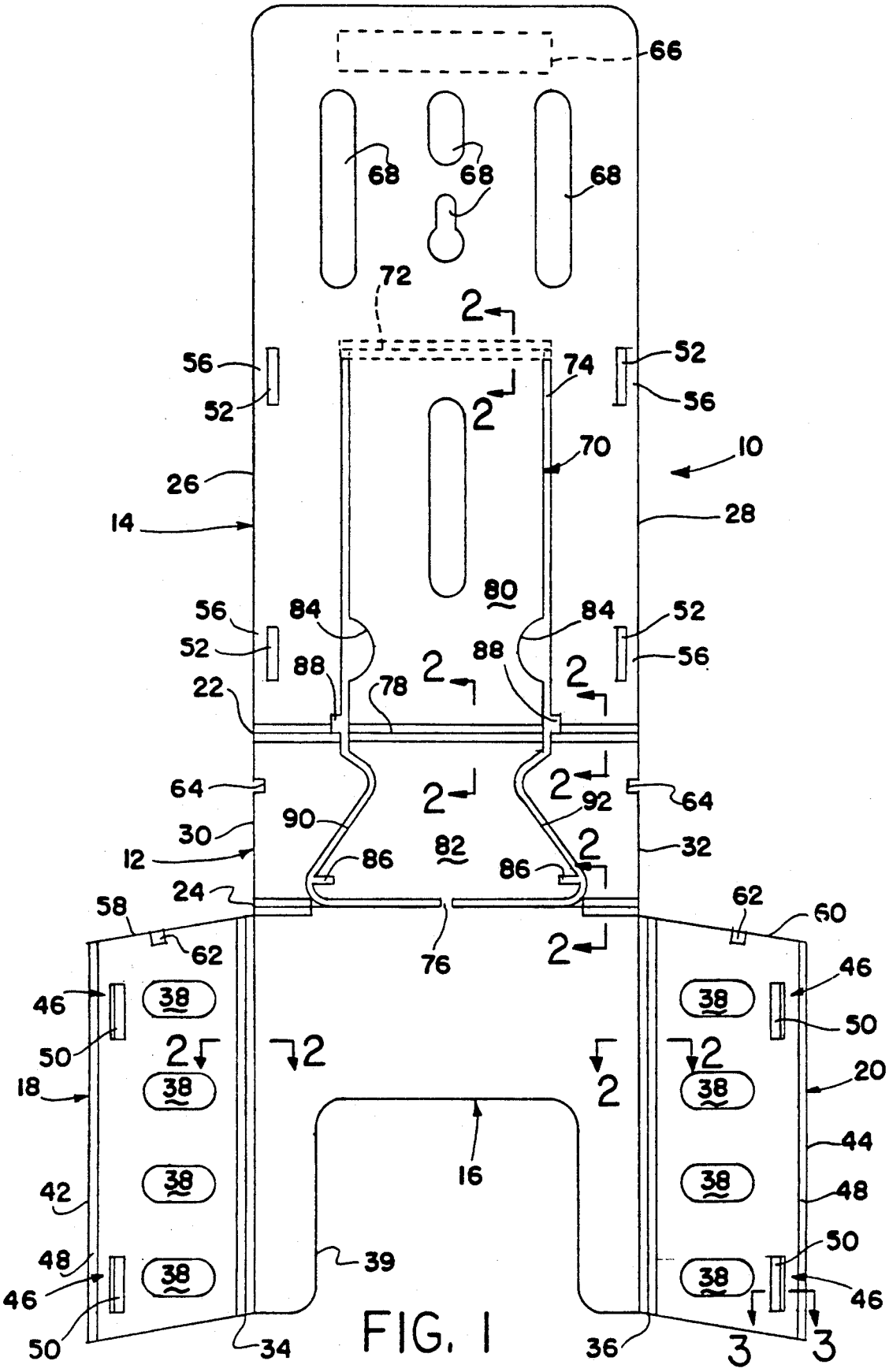
FIG. 1 is a plan view of the obverse side of a blank used to form a display box of the present invention showing bottom, front, back and side panels and a hinged easel panel inside the periphery of the back and bottom panels.

The blank 10 (FIG. 1) of the present invention includes an array of five connected panels joined along fold lines. As will become clear, the blank 10 may be folded along the fold lines to form the display box illustrated in FIGS. 6 and 9. Because of easy assembly, the blank 10 may be shipped flat and assembled at the point of use, typically a retail counter or the like where it may hold literature or other articles.

The blank 10 is an injection molded sheet of foldable plastic material, preferably approximately 0.070–0.080 inch in thickness, except at the hinge or fold lines, and it may be clear, transluscent, or opaque. It may have a glossy finish or a partially textured finish. The blank includes a bottom panel 12, a back panel 14, a front panel 16, and side panels 18 and 20. The back panel 14 is connected to the bottom panel 12 along first fold line 22. The bottom panel 12 is connected to the front panel 16 along a second fold line 24.

The first and second fold lines are parallel to each other and are perpendicular to side edges 26 and 28 of the back panel 14 and to side edges 30 and 32 of the bottom panel 12. Side panels 18 and 20 extend laterally from the front panel 16 and are joined to it along the third and fourth fold lines 34 and 36, respectively.

Figure 2:
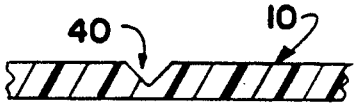
FIG. 2 is an enlarged fragmentary sectional view of a hinge looking in the direction of any of the arrows 2—2 of FIG. 1.

All the fold lines are essentially similar, and FIG. 2 illustrates one of them in cross section. A 90° V 40 formed in the surface of the blank defines the various fold lines. The V extends about half or two-thirds of the thickness of the blank. The relatively thin remaining section under the apex of the V 40 bends easily. The interior surfaces of the V 40 come together to form a neat miter joint between adjacent rigid and flat panels and the exterior corner is slightly rounded.

The side panels 18 and 20 (FIG. 1) may include various openings 38 which add a decorative appearance, and save unnecessary material thus making the blank 10 lighter and more economical to manufacture. The front panel 16 may include the U-shaped cut out 39 to make it easier to withdraw articles from a display box assembled from the blank 10.

Figure 3:
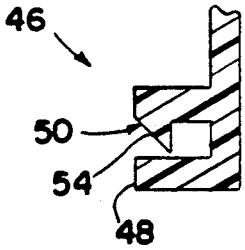
FIG. 3 is a similar view of the side panel capture flange and detent looking in the direction of arrows 3—3 of FIG. 1.

The distal edges 42 and 44 (FIG. 1) of the side panels 18 and 20, respectively, include grippers 46 which engage and lock onto the corresponding side edges 26 and 28, respectively, of the back panel 14 to hold the blank 10 assembled as a display box. The grippers 46 include a capture flange 48 extending outward from the plane of the panels 18 and 20 along the length of their respective distal edges 42 and 44. A pair of hook shaped detent projections 50 (FIG. 3) face each capture flange 48. The back panel 14 (FIGS. 1 and 3) includes four openings 52 which cooperate with the capture flange 48 and detent projections to lock the side panels to the back panel. See FIG. 7.

Figure 4:
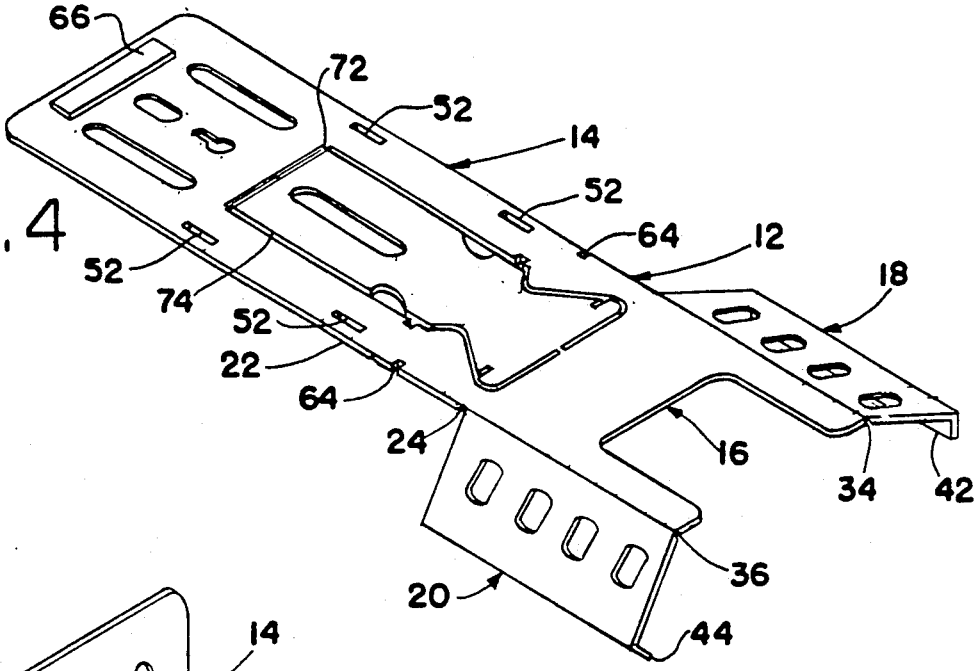
FIG. 4 is a perspective illustration of the reverse side of the blank of FIG. 1 partially folded into a display box.
Figure 5:
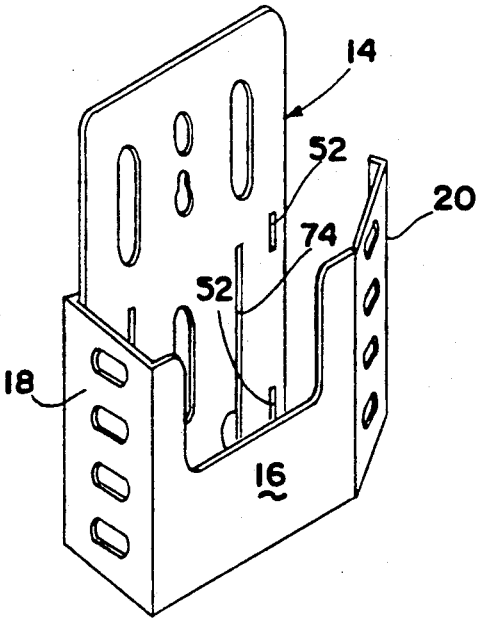
FIG. 5 is a perspective view of the blank of FIG. 4 at a subsequent stage of assembly.

The blank 10 is assembled into a display box by folding it along the various fold lines. As illustrated in FIG. 4, one may begin by folding the side panels 18 and 20 along the third and fourth fold lines 34 and 36, respectively. Next the front panel 16 is folded along the second fold line 24 and finally the back panel 14 is folded with respect to the bottom panel 12 along the first fold line 22. See FIG. 5.

Figure 6:
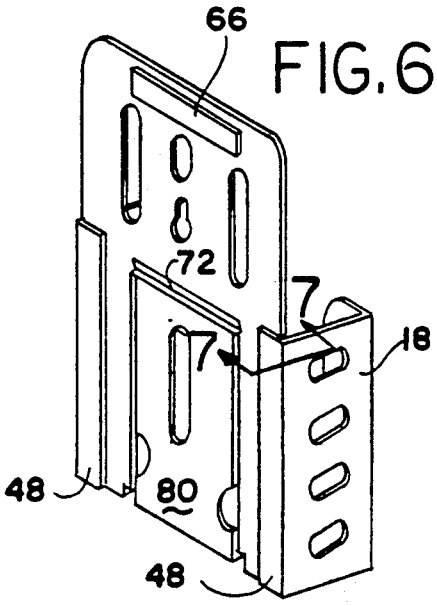
FIG. 6 is a perspective illustration of the blank of FIG. 5 fully assembled into a display box.
Figure 7:
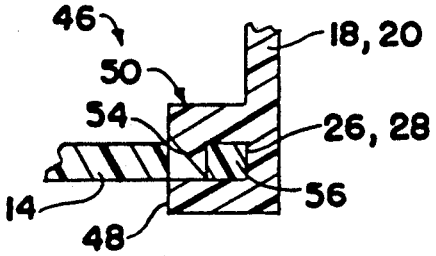
FIG. 7 is an enlarged view similar to FIG. 3 looking in the direction of arrows 7—7 of FIG. 6.

The grippers 46 (FIGS. 1 and 3) serve to hold the distal edges 42 and 44 of the side panels 18 and 20 to the side edges 26 and 28, respectively, of the back panel 14. This is accomplished by pressing the grippers 46 against the respective side edge of the back panel. As this is done the side edge of the back panel follows a cam surface 54 (FIG. 3) formed on the hook shaped detent projection 50 and presses the detent projection away from the capture flange 48. When locked in place, the isthmus 56 (FIGS. 1 and 7) formed between the side edge 26, 28 of the back panel and the opening 52 through the back panel is snugly surrounded by the capture flange 48 and the detent projection 50. As shown in FIGS. 6 and 7 the capture flange 48 extends laterally far enough inwardly from the respective side edges 26 and 28 to cover completely the openings 52, presenting a neat appearance.

The bottom edges 58 and 60 (FIG. 1) of the side panels 18 and 20, respectively, each carry a square pilot pin 62 which extends upward from the plane of the respective side panels. The side edges 30 and 32 of the bottom panel 12 carry corresponding square slots 64, one in side edge 30 and the other in side edge 32. When the blank 10 is folded to form a display box, each pilot pin 62 cooperates with the respective square slot 64 to help position the respective side panels 18 and 20. The side panel bottom edges 58 and 60 extend at a slight angle to the parallel fold or hinge lines 22 and 24, as do the parallel top edges of the side panels. In this manner, when assembled (FIG. 9) the bottom rests stably on a flat surface even though the box is inclined somewhat rearwardly.

Various means are provided for mounting the assembled display box. A foam strip 66 with adhesive coating on both sides may be positioned conveniently at the top of the outside of the back panel 14. Additionally various openings 68 are provided so that either a single or pair of hooks may be used to mount the display box to a panel such as a pegboard panel.

To permit the display box to be self-supporting, an easel panel 70 is formed spanning the back panel 14 and bottom panel 12. The easel panel is joined to the back panel along a fifth fold line 72 which is parallel to the first and second fold lines 22 and 24. The easel panel is defined by a generally U-shaped slot 74 which extends around the perimeter of the easel panel starting from one end of the fifth fold line 72 and ending at the opposite end. The U-shaped slot 74 is interrupted by a retaining tic 76 positioned along the midline of the easel panel 70 and opposite from the fifth fold line.

Figure 8:
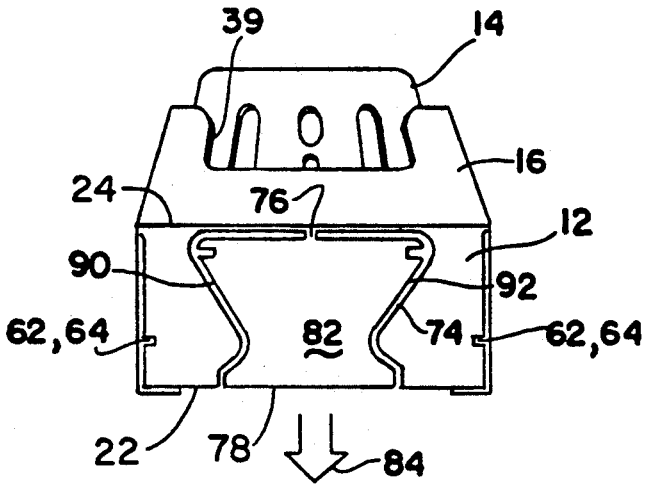
FIG. 8 is the bottom view of the box of FIG. 6 showing a portion of the easel panel.

The easel panel 70 includes a sixth fold line 78 which is coincident with the axis of the first fold line 22. The sixth fold line divides the easel panel 70 into a proximal portion 80 and a distal portion 82. So long as the retaining tic 76 remains unbroken the proximal portion 80 and distal portion 82 move together with the back panel 14 and bottom panel 12, respectively, as illustrated in FIG. 6. However, it is also possible to use the easel panel 70 to make a display box formed from the blank 10 self-supporting on a flat surface. To do this, the retaining tic 76 (FIG. 8) is broken by pulling the distal portion 82 of the easel panel 70 in the direction of arrow 84 shown in FIG. 8. Arcuate cut outs 84 (FIG. 1) in opposite edges of the proximal portion 80 of the easel panel 70 facilitate gripping the easel panel to break the tic 76.

Figure 9:
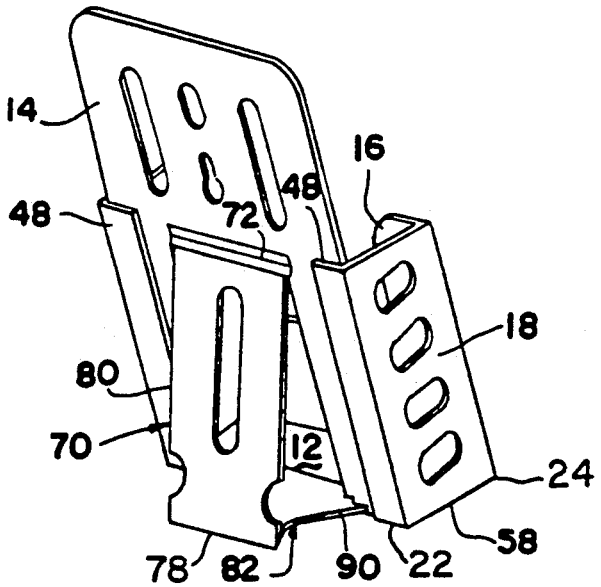
FIG. 9 is a perspective illustration of the box of FIG. 6 with the easel panel extended.

When the tic 76 has been broken and the easel panel 70 extended, its proximal portion 80 extends rearwardly and downwardly to form a supporting leg and its distal portion 82 lies substantially flat on the support surface as shown in FIG. 9. The easel panel 70 includes notches 86 formed in its distal portion 82 which engage corresponding notches 88 formed in the perimeter of the U-shaped slot 74 adjacent the first fold line 22. When the notches 86 are engaged with the notches 88, the easel panel is locked in a rearwardly projecting position as shown in FIG. 9 with the proximal portion 80 forming a downwardly extending leg and the distal portion 82 lying substantially against a support surface. The positions of the fifth and sixth fold lines as well as of the notches 86 are selected so that the back panel 14 is inclined rearwardly slightly when the easel panel is in its extended position.

The distal portion 82 (FIG. 1) is contoured to assist matching the notches 86 with the notches 88. The distal portion 82 is formed with sides 90 and 92 which taper away from each other as they recede from the fold line 78. As the easel panel is pulled rearwardly the sides 90 and 92 ride in a corresponding one of the notches 88. The spacing between the bottoms of the notches 86 is the same as that between the bottoms of notches 88. For this reason it may be necessary to arch or bend the distal panel 82 slightly in order to fit notches 86 and 88 together. Having the tapered edges 90 and 92 engaged by the notches 88 facilitates this since it is only necessary to press upward on the middle of the distal panel to accomplish the necessary bending.

Referring to FIG. 1, as indicated it is apparent that the bottom edge 58 of side panel 18 and the bottom edge 60 of side panel 20 are not perpendicular to their respective adjacent fold lines 34 and 36. The side panels 18 and 20 are thus parallelograms but not rectangles. The result is that the bottom panel 12 of the assembled display box is at an angle to the back and front panels when fully assembled. This angle is selected so that, when the easel panel 70 is in the extended position shown in FIG. 9, the plane of the distal portion 82 of the easel panel is substantially coincident with the plane defined by the bottom edges 90 and 92 of the sides 18 and 20, respectively. This provides the assembled display box with substantial stability.

The rigid planar panels give the box the appearance of a box which has not been assembled from a flat condition, and with the connections visually hidden the box does not detract from the product or literature displayed. The box thus has the appearance and stability of more expensive boxes. Moreover, the box can be supported in a variety of ways.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A fold up display box comprising:

a bottom panel, a back panel hingedly connected to the back edge of said bottom panel, a front panel hingedly connected to the front edge of said bottom panel, side panels hingedly connected to the sides of said front panel, gripping means to secure said side panels to the edges of said back panel when the panels are folded and the box assembled, said gripping means comprising a capture flange on the outer edge of each side panel extending behind the edges of said back panel, and detent projections on said side panels spaced from said capture flanges substantially the thickness of said back panel and engaging said back panel when the edges of said back panel are positioned between said capture flanges and projections, and an easel panel comprising a proximal portion which is hingedly connected to said back panel and a distal portion hingedly connected to said proximal portion, wherein in a first position said proximal portion is part of said back panel and in a first position said distal panel is part of said base panel, a retaining tie for holding said distal panel to said base panel and wherein when said retaining tie is broken said proximal portion is foldable from said first position to a second position at an angle to said back panel to support said box in an upright position and wherein when said tie is broken said distal portion is movable to a second position to engage said back panel to hold said easel panel in said second position wherein said distal portion and said back panel each include notches which cooperate to latch said distal portion in said second position and wherein said distal portion includes tapering edges for guiding the notches in said distal portion into alignment with said notches in said back panel.

2. A display box as set forth in claim 1 wherein said edges of the back panel include holes into which said detent projections snap.

3. A display box as set forth in claim 2 wherein said holes are covered by said capture flanges when the box is assembled.

4. A display box as set forth in claim 3 wherein said detent projections include a cam surface to facilitate the entry of said back panel edges between said capture flanges and projections.

5. A display box as set forth in claim 4 wherein said back panel has top and bottom edges and is hingedly connected at said bottom edge to said rear edge of said bottom panel.

6. A fold up literature display box comprising:

a continuous array of injection molded planar plastic panels, said array including:

a bottom panel, a back panel hingedly connected to the back edge of said bottom panel along a first fold line, a front panel hingedly connected to the front edge of said bottom panel along a second fold line, side panels hingedly connected to the sides of said front panel and including distal edge portions, means to secure said distal edge portions of said side panels to the edges of said back panel when the box is folded and assembled, and a hinged easel panel comprising a proximal portion which in a first position is in the plane of said back panel and which in a second position extends at an angle rearwardly of said back panel and can be locked in position to support said box in an upright position, said proximal portion being hinged at its top to said back panel and at its bottom along a third fold line to a distal portion of said easel panel, said distal portion comprising a removable portion of said bottom panel which in a first position is in the plane of said bottom panel and which can be removed from said bottom panel and in a second position can be locked to the bottom of said back panel to form a triangular support holding said box in an upright position, locking means for locking said distal portion to the bottom of said back panel, said locking means including a pair of oppositely opening notches formed in said distal portion and a cooperating pair of notches opening toward each other formed in the back panel wherein said distal portion includes oppositely tapered edges engageable in the notches of the back panel to guide the notches in the distal portion into engagement with the notches in the back panel wherein said third fold line is colinear with said first fold line in said first position of said proximal panel and in said second position of said proximal panel is so located in relation to said first and second fold lines as to allow all of said first, second and third fold lines to rest on an associated support surface to provide the display box with substantial stability.

7. The display box of claim 6 wherein the hinged connection between said easel panel and said removable portion of said bottom panel defines an axis coincident with the axis defined by the hinged connection between the back and bottom panels before said removable portion is removed.

8. A blank which is foldable into a literature display box comprising a continuous array of injection molded planar plastic panels each connected along miter lines comprising a bottom panel joined along a first transverse fold line to a back panel and along a second transverse fold line to a front panel, the front panel being joined to a pair of opposing side panels along third and fourth fold lines, said side panels having distal edges, fastener means for securing said distal edges of said side panels to the back panel, and an easel panel connected with the back panel along a fifth fold line parallel to the first fold line, the easel panel spanning the first fold line and wherein the easel panel has a proximal portion and a distal portion remote from the fifth fold line and connecting means for connecting the distal end portion of the easel panel with the back panel proximate the first fold line, wherein the easel panel includes a sixth fold line defining proximal and distal portions of the easel panel, and the fifth and sixth fold lines and the connecting means are positioned and proportioned so that when the blank is assembled into a box and the distal end portion of the easel panel is connected with the back panel proximate the first fold line, the distal portion of the easel panel is substantially coplanar with the bottom panel, wherein said distal portion has tapered side edges which taper towards said proximal portion, and wherein said distal portion needs to be arched in order to allow said connecting means to secure said distal portion to said back panel, and wherein the back panel is generally planar and has opposing planar faces.

9. The blank of claim 8 wherein the back panel has side edges transverse to the first fold line, and the fifth fold line terminates short of the side edges of the back panel.

10. The blank of claim 9 wherein the bottom panel includes side edges connecting the first and second fold lines and each side panel includes a bottom edge disposed at an angle to the side edges of the bottom panel whereby when the side panels are folded along the third and fourth fold lines and the front panel is folded along the second fold line, the side edges of the bottom panel may be joined with the bottom edges of the side panels and the front and bottom panels define an acute angle.

11. The blank of claim 10 wherein the connecting means includes interfitting notches in the distal end portion of the easel panel and the back panel.

12. The blank of claim 8 formed of foldable molded plastic sheet material having opposite generally planar faces.

13. The blank of claim 8 including a pilot pin extending from the bottom edge of each side panel and a corresponding notch in each side edge of the bottom panel.

* * * * *